US008371624B2

(12) United States Patent
Karwowicz et al.

(10) Patent No.: US 8,371,624 B2
(45) Date of Patent: Feb. 12, 2013

(54) DEVICE AND KIT FOR DECORATING BARRETTES

(75) Inventors: Julie Ann Karwowicz, Macomb, MI (US); David J. Crorey, Clinton Township, MI (US)

(73) Assignee: Crorey Creations, Inc., Clinton Township, MI (US)

( * ) Notice: Subject to any disclaimer, the term of this patent is extended or adjusted under 35 U.S.C. 154(b) by 0 days.

(21) Appl. No.: 13/274,848

(22) Filed: Oct. 17, 2011

(65) Prior Publication Data

US 2012/0261302 A1 Oct. 18, 2012

Related U.S. Application Data

(63) Continuation-in-part of application No. 29/389,813, filed on Apr. 18, 2011, now Pat. No. Des. 656,524.

(51) Int. Cl.
*D03J 3/00* (2006.01)

(52) U.S. Cl. ..... 289/17

(58) Field of Classification Search ..... 289/17, 289/18.1, 13; 63/43; 223/46; 87/8, 13, 33, 87/62; 446/491
See application file for complete search history.

(56) References Cited

U.S. PATENT DOCUMENTS

| | | | | |
|---|---|---|---|---|
| 758,376 | A | 4/1904 | Mees | |
| 1,203,781 | A | 11/1916 | Ratycia | |
| 2,043,082 | A | 6/1936 | Wallach | |
| 2,072,668 | A | 3/1937 | Eltgroth | |
| 2,123,077 | A * | 7/1938 | Mayer | 28/151 |
| 2,129,297 | A * | 9/1938 | Zippel | 28/151 |
| D112,814 | S * | 1/1939 | Lovgren et al. | D15/66 |
| D134,208 | S | 10/1942 | McCrary | |
| D142,530 | S | 10/1945 | Rosenblatt | |
| 2,395,981 | A | 3/1946 | Walker | |
| 2,542,222 | A * | 2/1951 | Welch | 223/46 |
| 2,601,222 | A | 6/1952 | Wehrli | |
| D204,442 | S | 4/1966 | Brawley, Jr. | |
| D211,685 | S * | 7/1968 | Hill et al. | D22/149 |
| 3,545,069 | A | 12/1970 | Krieger | |
| 3,650,010 | A | 3/1972 | Powell, Jr. | |
| 3,708,862 | A | 1/1973 | Powell, Jr. | |
| 3,800,372 | A | 4/1974 | Daoust | |
| 3,850,293 | A * | 11/1974 | Scaringi | 206/575 |
| D238,812 | S | 2/1976 | Fioretti | |
| 4,045,061 | A | 8/1977 | Fierro | |
| 4,103,944 | A | 8/1978 | Alvarado et al. | |
| D257,257 | S | 10/1980 | McArthur | |
| 4,260,185 | A | 4/1981 | Shiplee, III | |

(Continued)

FOREIGN PATENT DOCUMENTS

| | | | |
|---|---|---|---|
| JP | 01256315 | A | 10/1989 |
| WO | 2006053909 | A1 | 5/2006 |

OTHER PUBLICATIONS

Notification of Transmittal, International Search Report and Written Opinion dated Aug. 19, 2010 from the corresponding International Application No. PCT/US2010/021101.

*Primary Examiner* — Shaun R Hurley
(74) *Attorney, Agent, or Firm* — Young Basile

(57) ABSTRACT

Disclosed herein are embodiments of devices and kits for making barrettes covered with ribbon. One embodiment of a device for making decorated barrettes comprises a base having a substantially planar surface with a first end and a second end opposite the first end, a securing member connected to the substantially planar surface proximate to the first end and configured to secure a barrette and at least one elongated holder connected to the substantially planar surface proximate the second end. The at least one elongated holder comprises a plurality of raised portions extending outward from the substantially planar surface in close proximity to one another to define slits there between configured to retain an individual ribbon.

15 Claims, 6 Drawing Sheets

U.S. PATENT DOCUMENTS

| | | | | |
|---|---|---|---|---|
| 4,401,329 | A | 8/1983 | Pedroia | |
| 4,613,173 | A * | 9/1986 | Rosser | 289/17 |
| 5,975,383 | A * | 11/1999 | Cavender et al. | 223/46 |
| 6,000,586 | A * | 12/1999 | Cavender | 223/46 |
| 6,119,854 | A | 9/2000 | Prentice et al. | |
| 6,719,013 | B1 | 4/2004 | D'Estais | |
| 6,910,748 | B1 | 6/2005 | Fountain | |
| 7,147,008 | B2 | 12/2006 | Sayler | |
| 7,309,086 | B2 * | 12/2007 | Carrier | 289/17 |
| D563,997 | S | 3/2008 | Gustin | |
| D619,150 | S | 7/2010 | Crorey | |
| D626,574 | S | 11/2010 | Crorey | |
| 7,946,631 | B2 | 5/2011 | Crorey | |
| 8,172,281 | B2 * | 5/2012 | Crorey | 289/17 |
| 2006/0169608 | A1 | 8/2006 | Carnevali | |
| 2007/0182157 | A1 * | 8/2007 | Carrier | 289/17 |
| 2010/0019495 | A1 * | 1/2010 | Oliveto | 289/1.5 |
| 2010/0218840 | A1 * | 9/2010 | Crorey | 139/29 |
| 2011/0181043 | A1 * | 7/2011 | Crorey | 289/17 |

* cited by examiner

DEVICE AND KIT FOR DECORATING BARRETTES

CROSS REFERENCE TO RELATED APPLICATION

This application claims priority to U.S. Design application Ser. No. 29/389,813 filed on Apr. 18, 2011 and incorporated herein in its entirety.

TECHNICAL FIELD

The embodiments disclosed relate in general to hand crafted accessories and more particularly to devices to assist the making of decorated accessories such as barrettes.

BACKGROUND

Barrettes are popular for girls of many ages and barrettes covered in ribbon are particularly desired. However, such barrettes can often be expensive. A device for making ribbon covered barrettes would enable a person of any skill level to made the barrettes herself.

BRIEF SUMMARY

Disclosed herein are embodiments of devices for making barrettes covered with ribbon. One embodiment of a device for making decorated barrettes comprises a base having a substantially planar surface with a first end and a second end opposite the first end, a securing member connected to the substantially planar surface proximate to the first end and configured to secure a barrette and at least one elongated holder connected to the substantially planar surface proximate the second end. The at least one elongated holder comprises a plurality of raised portions extending outward from the substantially planar surface in close proximity to one another to define slits there between configured to retain an individual ribbon.

Also disclosed herein are embodiments of kits for making ribbon covered barrettes. One embodiment of a kit for making decorated barrettes comprises a device having a base having a substantially planar surface with a first end and a second end opposite the first end, a securing member connected to the substantially planar surface proximate to the first end and configured to secure a barrette and a pair of elongated holders connected to the substantially planar surface proximate the second end. Each elongated holder comprises a plurality of raised portions extending outward from the substantially planar surface in close proximity to one another to define slits there between configured to retain an individual ribbon. A plurality of ribbons are included having a center for temporary engagement with the securing member, portions proximate first ends of the ribbons moveable between adjacent raised portions of one of the pair of the elongated holders and portions proximate second ends of the ribbons movable between adjacent raised portions of another of the pair of elongated holders.

Other embodiments are described in more detail in the detailed description herein.

BRIEF DESCRIPTION OF THE DRAWINGS

The description herein makes reference to the accompanying drawings wherein like reference numerals refer to like parts throughout the several views, and wherein.

DETAILED DESCRIPTION OF THE EMBODIMENTS

Figure 1A:
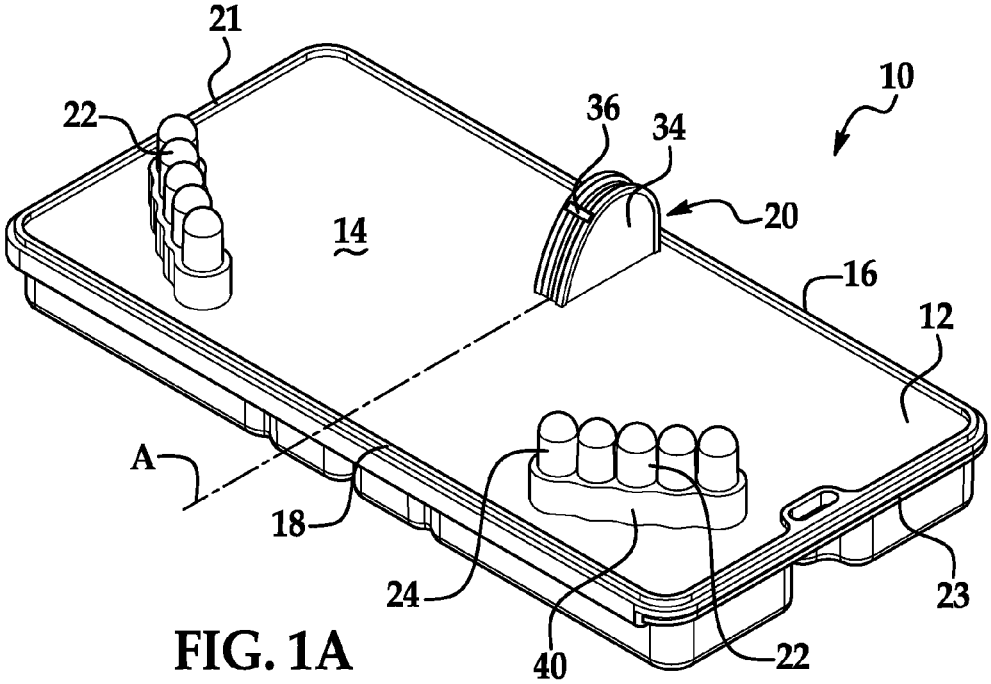
FIG. 1A is a perspective view of an embodiment of a device for making decorated barrettes as disclosed herein.
Figure 1B:
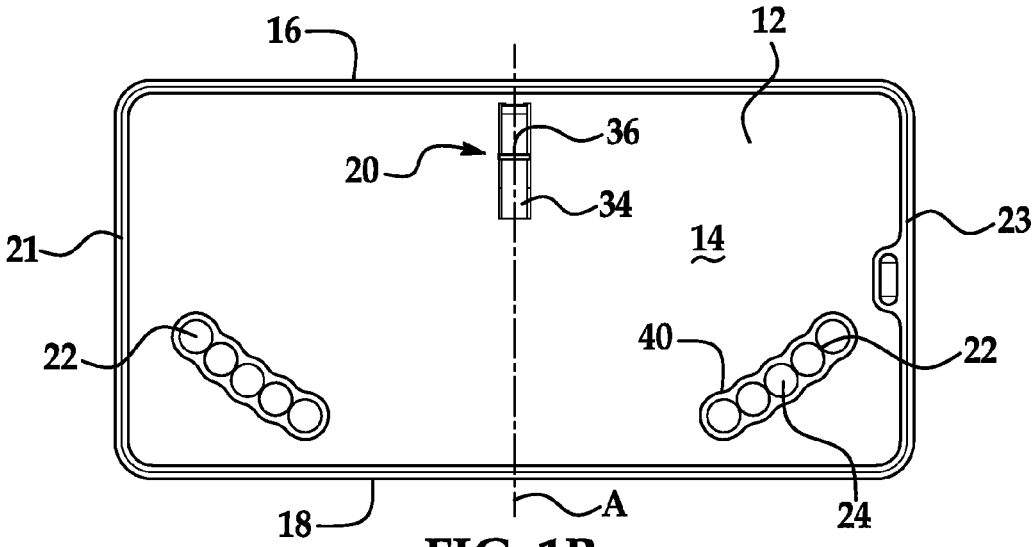
FIG. 1B is a plan view of the device of FIG. 1A.
Figure 1C:
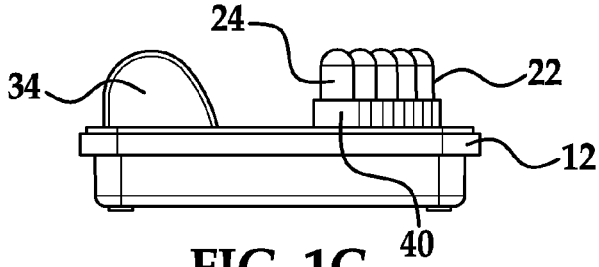
FIG. 1C is a first side view of the device of FIG. 1A.
Figure 1D:
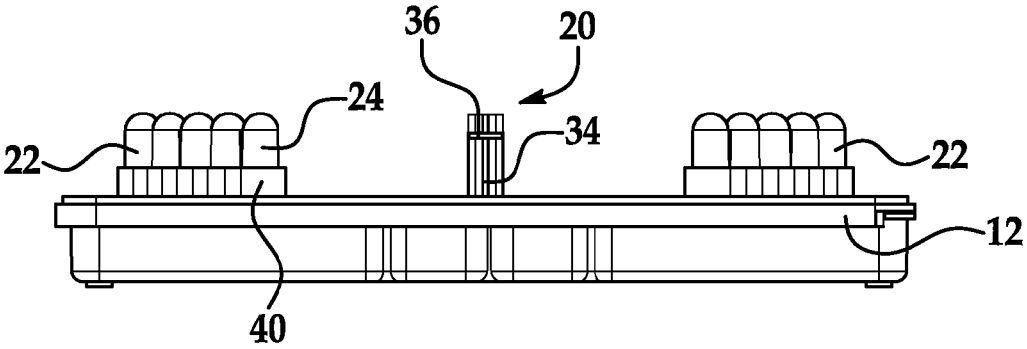
FIG. 1D is a second side view of the device of FIG. 1A.

FIGS. 1A-1D illustrate an embodiment of a device for decorating barrettes. As used herein, the term "barrette" refers to items that can be used to hold hair in place in addition to barrettes, such as hair clips, hair pins and the like. The device 10 for decorating barrettes includes a base 12 having a substantially planar surface 14 with a top 16, bottom 18 opposite the top 16, and an axis A. First side 21 and second side 23 opposite the first side 21 extend between top 16 and bottom 18. As used herein, the terms "top" and "bottom" and "sides" are used to describe the relationship of the elements to each other and are not meant to construe any limitations to the embodiments herein.

A securing member 20 is carried by the substantially planar surface 14 proximate the top 16 and between the first side 21 and second side 23. The securing member 20 can be integrally formed with the planar surface 14, connected to the planar surface 14 with adhesive, clipped into an opening in the planar surface 14, fastened to the planar surface 14 with a fastener, or any other means known to those skilled in the art to attach the securing member 20 to the planar surface 14. Two elongated holders 22 are connected to the substantially planar surface 14 proximate the bottom 18, with one of the elongated holders closer to the first side 21 and the other of the elongated holders 22 closer to the second side 23. Each of the elongated holders 22 comprises a plurality of raised portions 24 positioned along the elongated holder 22 and extending outward from the substantially planar surface 14 in close proximity to one another. Adjacent raised portions 24 are configured to retain individual pieces of ribbon. The elongated holders 22 can be integrally formed with the planar surface 14, connected to the planar surface 14 with adhesive, clipped into an opening in the planar surface 14, fastened to the planar surface 14 with a fastener, or any other means known to those skilled in the art to attach the elongated members 22 to the planar surface 14.

As used herein, "substantially planar surface" and "planar surface" as used herein both mean having a two-dimensional characteristic able to position the securing member 20 and the elongated holders 22 as required for decorating the barrettes.

The term does not limit the surface to being smooth, as the surface may be textured or embossed if desired or required. The axis A is an axis of the device running from the top 16 to the bottom 18 and vice versa. The axis is for directional and positioning purposes only.

Figure 2:
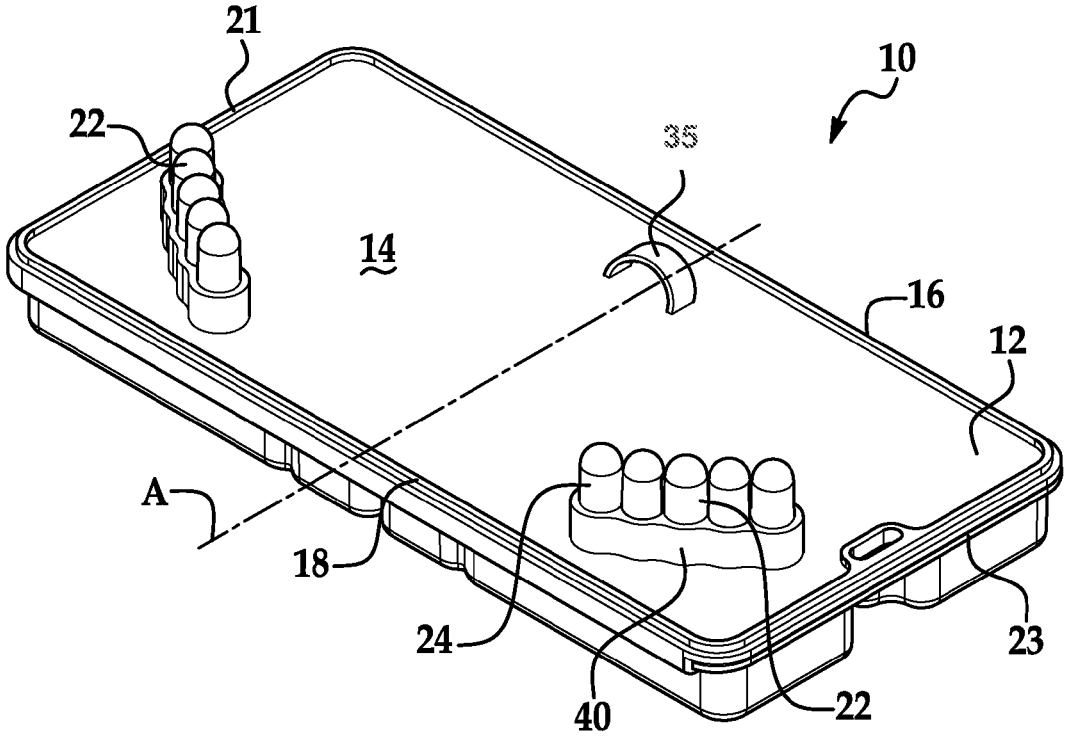
FIG. 2 is a perspective view of the device of FIG. 1A illustrating an alternative aspect of a securing member.
Figure 3:
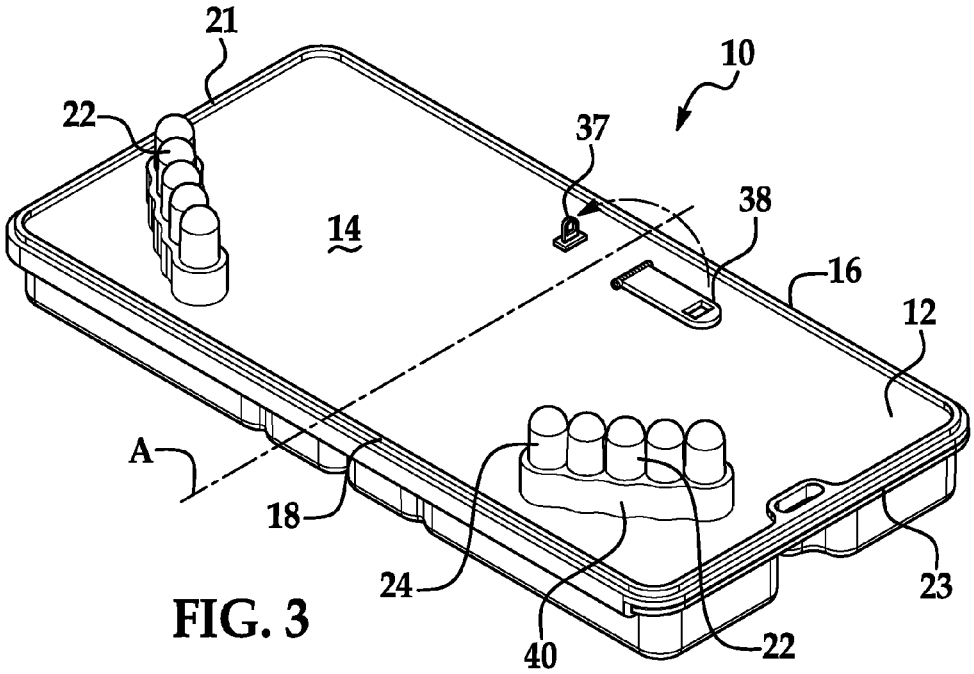
FIG. 3 is a perspective view of the device of FIG. 1A illustrating yet another alternative aspect of the securing member.

The securing mechanism 20 can be a raised protrusion 34 with a slot 36 in the protrusion 34 as shown in FIGS. 1A-1D. The slot 36 is configured to retain the underside of the barrette 25 when it is slid into the slot 36. The slot 36 in the protrusion 34 shown in FIG. 1 is positioned to face a user of the device 10; however, the slot 36 can be positioned on top of the protrusion 34. The protrusion 34 can be any shape desirable, such as a flower, peace sign or smiley face. The securing mechanism 20 can be any other configuration that sufficiently holds the barrette 25 in a position to decorate. Examples include a raised loop 35, as shown in FIG. 2 or a hook 37 and latch 38 as shown in FIG. 3. These are provided by means of example and are not meant to be limiting. The securing mechanism 20 can be made of the same material as the base 12 or can be a different material. The securing mechanism 20 can be made of metal, plastic or foam, as non-limiting examples.

Figure 4:
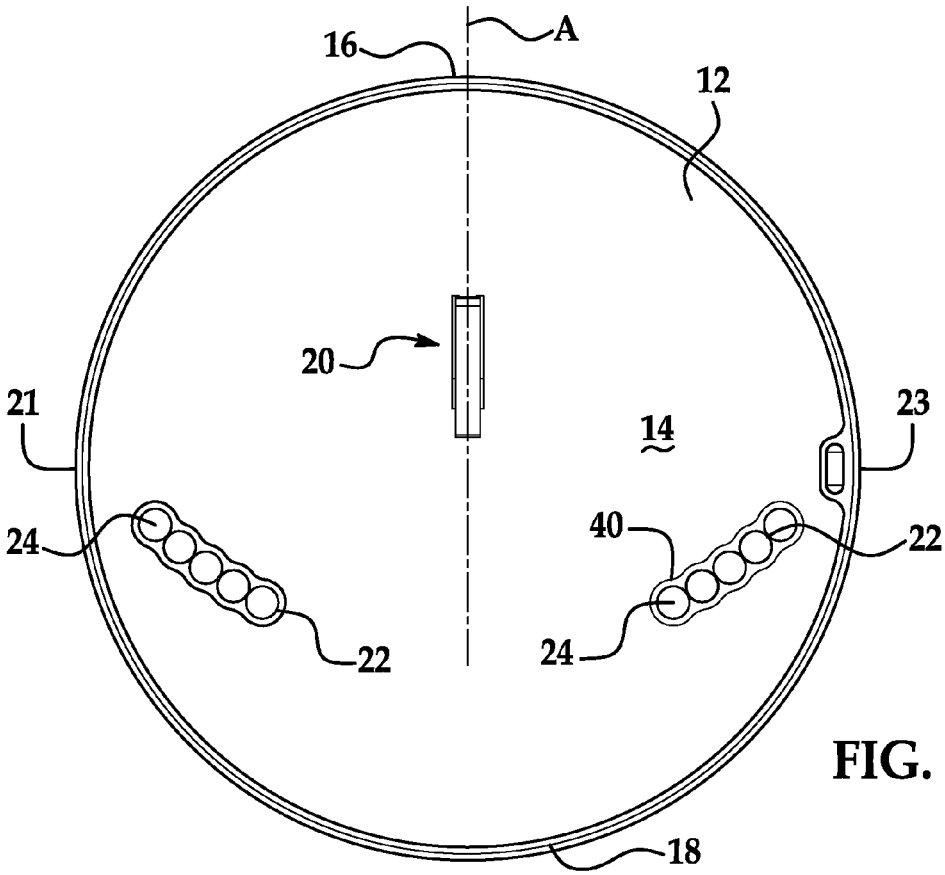
FIG. 4 is a plan view of another embodiment of the device disclosed herein.

The base 12 is shown as being rectangular, but this is for example only. The base can be any shape providing a planar surface 14 to support the securing member 20 and elongated holders 22 substantially in the configuration shown. As a non-limiting example, the base can be circular as shown in FIG. 4.

The securing member 20 can be movably attached to the base 12 and positionable at a plurality of discrete locations defined along the base 12 if desired. The plurality of discrete locations to which the securing member 20 can be moved functions to maintain some tautness to the ribbons as completion of the barrette progresses. For example, as the length of the unwrapped ribbon decreases, the securing member 20 can be moved toward the bottom 18, and thus the elongated holders 22, so that the shorter ribbon can be retained between the raised portions 24.

Figure 5:
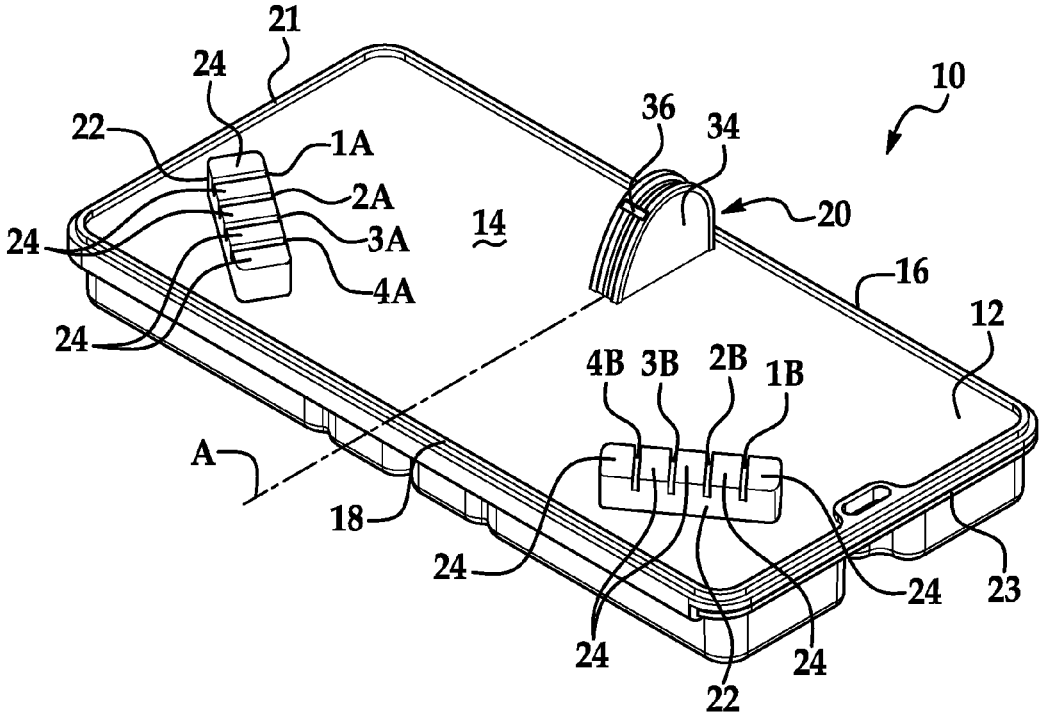
FIG. 5 is a perspective view of the device of FIG. 1A illustrating an alternative aspect of an elongated member.

As discussed above, embodiments of the device 10 disclosed herein comprise elongated holders 22 each having a plurality of raised portions 24 along the holder 22. As shown in FIGS. 1A-1D, the elongated holders 22 can have a base portion 40 with raised portions 24 extending therefrom. The base portion 40 and raised portions 24 can be made from any suitable material, such as plastic, foam, rubber, or metal. As shown in FIG. 5, the elongated holders 22 can be made from a piece of foam or other elastic material and simply have slits 1A-4A, 1B-4B cut into the foam to hold the ribbon. The slits define the raised portions 24.

To tighten the grip between raised portions 24, pieces of elastic material can be placed between the adjacent raised portions to elastically compress the ribbon. The piece of elastic material can be integrally molded with the raised portions. Alternatively, adjacent raised portions not made of foam or rubber can be coated with an elastic material like rubber to hold the ribbons there between.

The elongated holders 22 can be a continuous single elongated holder having enough slots for both sides of the ribbons. However, providing two separate elongated holders 22 is simpler for younger users to manipulate. The elongated holders 22 can be linear, or can be curved. The elongated holders 22 are each shown with four slots as an example. However, any number of slots can be incorporated. The elongated holders do not have to have an equal number of slots, but an equal number simplifies use.

The configuration of the securing member 20 in relation to the elongated holders 22 is exemplary. The elongated holders 22 can be further from or closer to axis A. The securing member 20 can also be closer to or further from the elongated holders 22. The elongated holders 22 are shown at an oblique angle to the axis A but the particular angle is not required. The elongated holders 22 can be perpendicular to the axis A or at an oblique angle to the axis A that is not shown. The securing member 20 and elongated holders 22 in general form a triangle on the planar surface 14 as seen in the figures.

Figure 6:
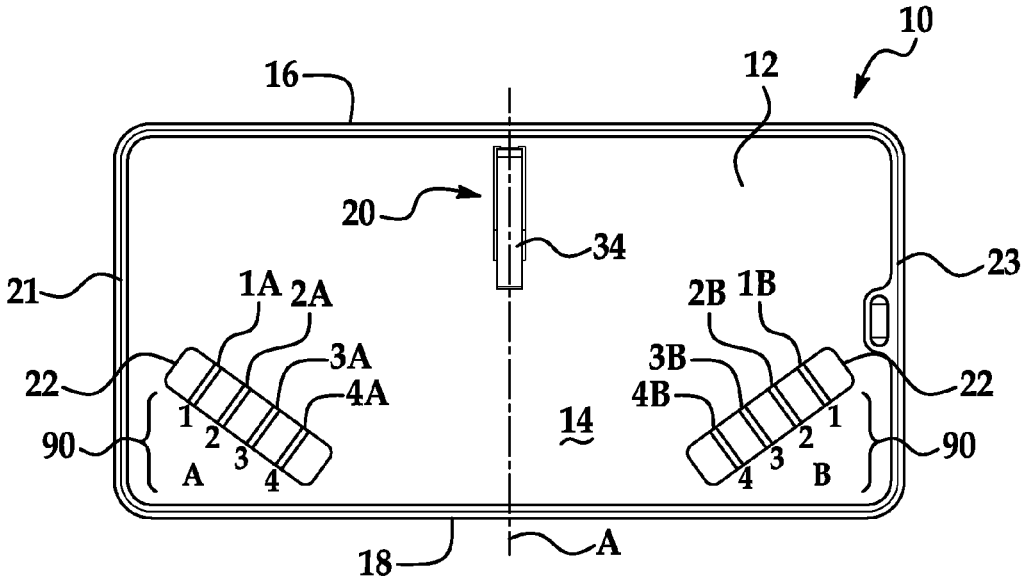
FIG. 6 is a plan view of another aspect of the embodiment of the device illustrated in FIG. 1A.

Embodiments of the device 10 disclosed herein can have indicia 90 on the substantially planar surface 14 of the base 12. The indicia 90 can be located proximate the elongated holders 22 to differentiate the plurality of raised portions 24. As shown in FIG. 6, the indicia 90 comprise numbers in series and equal to the number of raised portions 24, however letters can also be used in addition to or alternatively to numbers. The indicia 90 can be used to assist in the making of the accessory or assist in instructing a user how to use the device 10. Other indicia 90 are contemplated as desired or required. The indicia can also be located directly on the elongated members 22.

Figure 7:
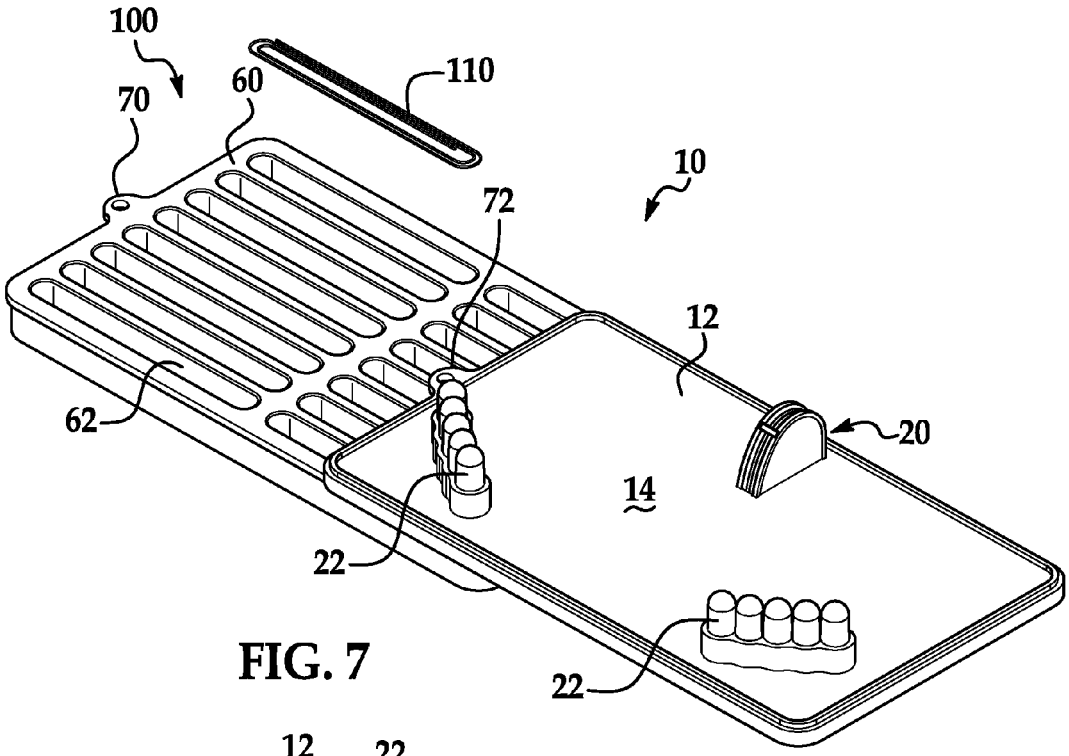
FIG. 7 is a perspective view of an embodiment of a kit for making decorated barrettes a storage compartment as disclosed herein.

Embodiments of the device 10 for making decorated barrettes can also comprise a storage compartment 60, shown in FIG. 7. The storage compartment 60 can have at least one inner cavity 62. In FIG. 7, the embodiment is shown with many inner cavities 62 by way of example. The inner cavities can be any shape or size desired or required. The storage compartment 60 can store anything that is sized to be retained in the inner cavities 62. However, it is contemplated that different ribbons, beads, gems, instructions, patterns and barrettes will be stored in the inner cavities 62.

Figure 8:
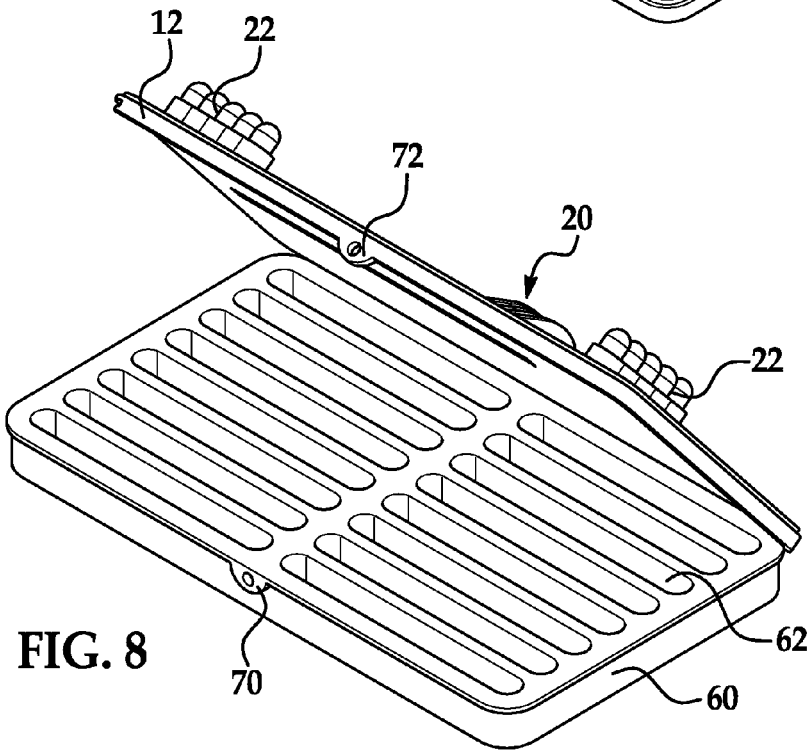
FIG. 8 is a perspective view of another embodiment of the storage compartment as disclosed herein.

The storage compartment 60 can releasably engage the base 12. For example, the base 12 can be slidably attached to the storage compartment 60 so that it is moveable between an open position and a closed position. FIG. 7 is a perspective view of the base 12 slidably attached to the storage compartment 60, with the base 12 in a partially open position. One or more of the inner cavities can be exposed when the base 12 is in an open or partially open position, allowing communication with the exposed inner cavities to retrieve or store items. FIG. 8 is another example of a storage compartment 60 releasably engaged with the base 12. In this alternative, the base 12 is pivotally attached to at least one side of the storage compartment 60 and is movable between an open position and a closed position. The base 12 can be pivotally attached to any one of the sides of the storage compartment and can be attached, for example, by one or more hinges and the like.

The Figures herein illustrate the base 12 and the storage compartment 60 as being rectangular in shape. This shape is provided by way of example and is not meant to be limiting. The base 12 and storage compartment 60 can be other shapes, for example, square, triangular, hexagonal, etc. The base 12 and storage compartment 60 can be different shapes from each other. The base 12 can have a larger surface area than the storage compartment 60. The storage compartment 60 can be as deep as desired or required. The storage compartment 60 can be a drawer in the base 12 if the base 12 has sufficient depth.

Embodiments of the device 10 disclosed herein can further have a latching mechanism configured to secure the base 12 to the storage compartment 60 in the closed position. Both FIGS. 7 and 8 illustrate the latching mechanism as having a latch member 70 on the storage compartment 60 and a latch member 72 on the base 12 that cooperate with one another so that when in the closed position, the apertures in the latch members 70, 72 align to receive, for example, a pin, a lock, a tie or a similar mechanism to maintain the latch members 70, 72 together. A pin, for example, can extend from one of the latch members 70, 72 to frictionally fit in the other of the latch members 70, 72. The latch mechanism shown in FIGS. 7 and 8 is provided by way of example and is not meant to be limiting. Other means can be used to maintain the base and storage compartment in the closed position as desired or required.

Also disclosed herein are embodiments of kits for making decorated barrettes. One embodiment disclosed herein of a kit for making decorated barrettes comprises a device 10 as illustrated in any of FIGS. 1A-8. Embodiments of this device are described in detail above and are incorporated herein. Referring to FIG. 7 by way of illustration, the kit 100 comprises a device 10 as disclosed herein and further comprises a plurality of ribbons 110 or other accessories such as beads, barrettes, etc.

The kit 100 can include as much or as little ribbon as desired or required. The plurality of ribbons 110 can be one or more colors, one or more texture, and one or more material. For example, some of the plurality of ribbons 110 may be blue, red, orange, yellow, etc. In addition, individual ribbon can be multicolored. The plurality of ribbons 110 can be embroidery ribbon, yarn, thread, rope, etc. The plurality of ribbons 110 can be silk, cotton, rayon, etc.

Figure 9:
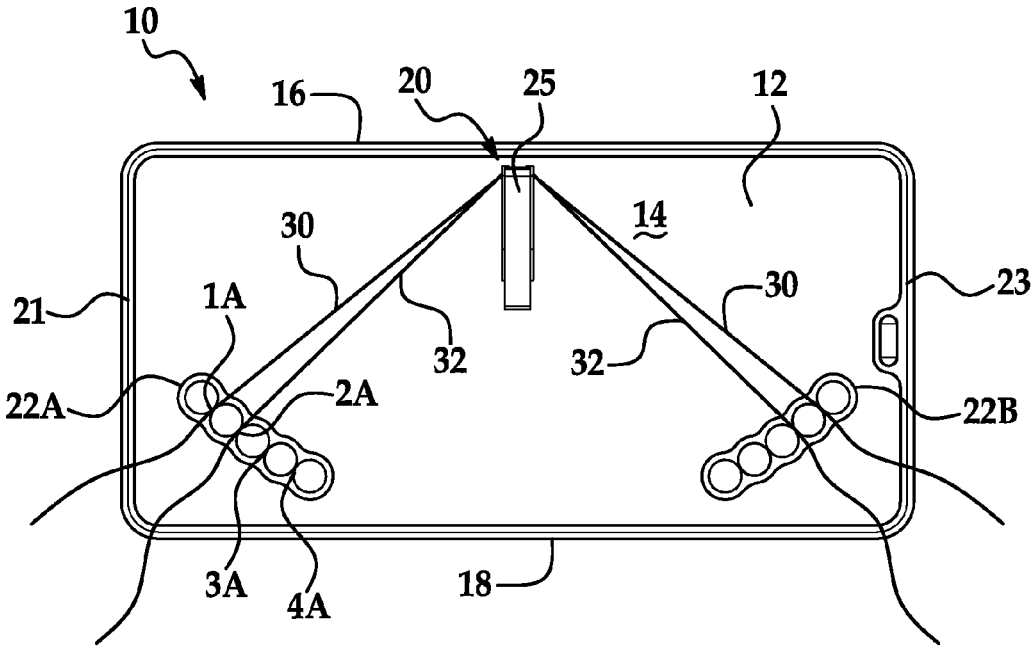
FIG. 9 is a plan view of the kit of FIG. 7 in use.

One or more individual ribbons are used with the device to make the decorated barrettes. FIG. 9 is a plan view of FIG. 1 with a barrette 25 installed in the securing member 20 with ribbons 30, 32 tied onto the barrette 25 for use in the device 10. One ribbon can be used to produce a decorated barrette of one color, or more than one ribbon can be used to produce a variety of color combinations. The use of two ribbons will be described herein as a non-limiting example. In use, the center of the two ribbons 30, 32 is located and the ribbons 30, 32 are tied at their center around a bottom portion of the barrette 25 when the barrette 25 is positioned in the securing member 20. One side of a first ribbon 30 is retained between adjacent raised portions in slot 1A of the elongated holder 22A such that the ribbon is sufficiently taut. The other side of the first ribbon 30 is retained between adjacent raised portions in slot 1B of the elongated holder 22B, as shown in FIG. 9. One side of a second ribbon 32 is retained between adjacent raised portions in slot 2A of the elongated holder 22A such that the ribbon is sufficiently taut. The other side of the second ribbon 32 is retained between adjacent raised portions in slot 2B of the elongated holder 22B.

Figure 10:
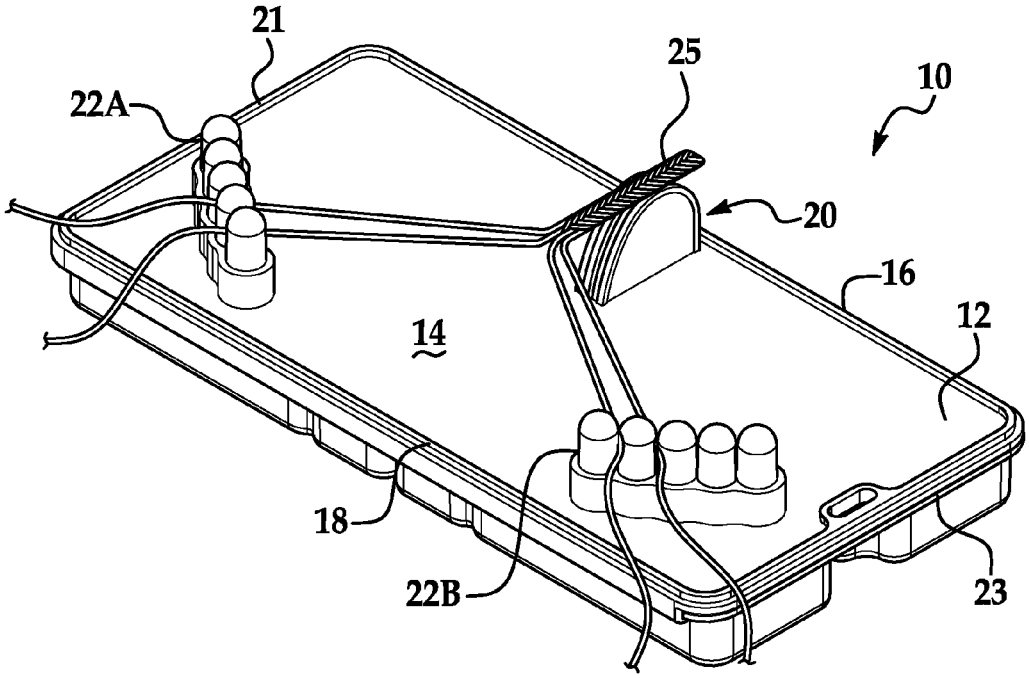
FIG. 10 is a plan view of the kit of FIG. 7 in a different stage of use.

To make the decorated barrettes, the typical method begins with removing one of the first side and second side of the first ribbon 30 from its elongated holder. As an example, the first side of first ribbon 30 will be removed from elongated holder 22A. The ribbon 30 will be wrapped around the barrette 25 and secured in elongated holder 22B in slot 3B. The second side of the first ribbon 30 will be removed from elongated holder 22B and wrapped around the barrette 25 and secured in elongated holder 22A in slot 3A. Next, the first side of the second ribbon 32 will be removed from elongated holder 22A and wrapped around the barrette 25 and secured in elongated holder 22B in slot 4B. The second side of the second ribbon 32 will be removed from elongated holder 22B and wrapped around the barrette 25 and secured in elongated holder 22A in slot 4A. The ribbons will continue to be wrapped in that fashion along slots 1A-4A and 1B-4B until the entire barrette 25 is decorated. The ribbons can then be tied in a knot and cut down to the barrette or to any length desired. Beads or other accessories can also be added to the ribbon. A nearly completed decorated barrette is illustrated in FIG. 10.

The method described above is provided by way of example and is not meant to be limiting. The movement of the ribbons and order in which they are taken up may be different depending on the pattern being made.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A device for making decorated barrettes comprising:

a base having a substantially planar surface with a first end and a second end opposite the first end;

a securing member connected to the substantially planar surface proximate to the first end and configured to secure a barrette;

a pair of elongated holders connected to the substantially planar surface proximate the second end, the pair of elongated holders comprising a plurality of raised portions extending outward from the substantially planar surface in close proximity to one another to define slits there between configured to retain an individual ribbon;

a storage compartment having at least one inner cavity and releasably engaging the base, wherein the storage compartment is configured to removably store a plurality of ribbons; and a latching mechanism configured to secure the base to the storage compartment in a closed position.

2. The device of claim 1, wherein the securing member is positioned on a central axis extending between the first end and the second end.

3. The device of claim 1, wherein the securing member is a protrusion extending from the substantially planar surface and comprising a slot on a surface of the protrusion opposite the substantially planar surface configured to receive a portion of the barrette.

4. The device of claim 1, wherein the securing member comprises a hook and a latch assembly, the hook and latch assembly configured to move between an open position to receive a portion of the barrette and a closed position to retain the portion of the barrette.

5. The device of claim 1, wherein the base is pivotally attached to at least one side of the storage compartment and is movable between an open position and the closed position.

6. The device of claim 1, wherein the base is slidably attached to the storage compartment and is moveable between an open position and a closed position.

7. The device of claim 1, wherein the storage compartment is slidably mounted within the base and is moveable as a drawer between an open position and the closed position.

8. The device of claim 1 further comprising indicia proximate the plurality of raised portions to sequence the raised portions.

9. The device of claim 1, wherein one of the pair of elongated members is positioned on one side of an axis extending between the first end and second end, and another of the pair of elongated members is positioned on another side of the axis.

10. The device of claim 1, wherein each of the pair of elongated members is positioned oblique to the axis.

11. A kit for making decorated barrettes comprising:

a device comprising:

a base having a substantially planar surface with a first end and a second end opposite the first end;

a securing member connected to the substantially planar surface proximate to the first end and configured to secure a barrette; and a pair of elongated holders connected to the substantially planar surface proximate the second end, each elongated holder comprising a plurality of raised portions extending outward from the substantially planar surface in close proximity to one another to define slits there between configured to retain an individual ribbon;

a plurality of ribbons having a center for temporary engagement with the securing member, portions proximate first ends of the ribbons moveable between adjacent raised portions of one of the pair of the elongated holders and portions proximate second ends of the ribbons movable between adjacent raised portions of another of the pair of elongated holders;

a storage compartment having at least one inner cavity and releasably engaging the base, wherein the plurality of ribbons are removably stored in the storage compartment; and a latching mechanism configured to secure the base to the storage compartment in the closed position.

12. The kit of claim 11, wherein the plurality of ribbons comprises at least one of: more than one color, more than one texture, and more than one material.

13. The kit of claim 11, wherein the device further comprises indicia proximate the plurality of raised portions to sequence the raised portions.

14. The kit of claim 11, wherein the securing member is a protrusion having an upper surface in which is defined a slot configured to receive a part of a barrette.

15. The kit of claim 11, wherein the securing member is positioned at a corner of a triangle and each of the pair of elongated holders is positioned at a respective remaining corner of the triangle.

* * * * *